US005303127A

United States Patent [19]

Kosann

[11] Patent Number: 5,303,127

[45] Date of Patent: Apr. 12, 1994

[54] LIGHTING FIXTURE

[76] Inventor: Sidney Kosann, 155 Rimmon Rd., Woodbridge, Conn. 06525

[21] Appl. No.: 915,019

[22] Filed: Jul. 16, 1992

[51] Int. Cl.[5] ..... F21V 7/00

[52] U.S. Cl. ..... 362/296; 362/217; 362/301; 362/346

[58] Field of Search ..... 362/290, 98, 296, 217, 362/297, 301, 346, 347, 812, 125, 126; 108/23

[56] References Cited

U.S. PATENT DOCUMENTS

| | | | |
|---|---|---|---|
| 1,800,857 | 4/1931 | Brown | 362/296 |
| 4,947,297 | 8/1990 | Druffel | 362/217 |
| 5,032,958 | 7/1991 | Harwood | 362/301 |

FOREIGN PATENT DOCUMENTS

| | | | |
|---|---|---|---|
| 1025177 | 4/1953 | France | 362/98 |
| 1269331 | 7/1961 | France | 362/217 |
| 174679 | 4/1935 | Switzerland | 108/23 |
| 399663 | 10/1933 | United Kingdom | 362/296 |

OTHER PUBLICATIONS

Advertisement for Art Light by Modulighter.

*Primary Examiner*—James C. Yeung
*Attorney, Agent, or Firm*—David P. Gordon

[57] ABSTRACT

A lighting fixture for illuminating hanging works of art has an enlarged reflector with a planar front section extending at a carefully chosen angle. A curved portion of the reflector has a large enough radius to permit the use of a compact fluorescent bulb with a separate or self-contained ballast. The fluorescent bulb preferably emits light in the daylight color temperature range. With the compact fluorescent bulb and the planar front section, an increased number of lumens are uniformly distributed over the object to be illuminated. The reflector is optionally provided with different types of reflective material to alter the quality of the light reflected and the reflector may be specially adapted to accept a number of different reflective materials. The fixture can be easily constructed of extruded material and is provided with all of the features for placement necessary to illuminate hanging works of art either individually or as a wall washer to illuminate a complete wall of art or bookshelves of any length.

16 Claims, 6 Drawing Sheets

FIG. 2
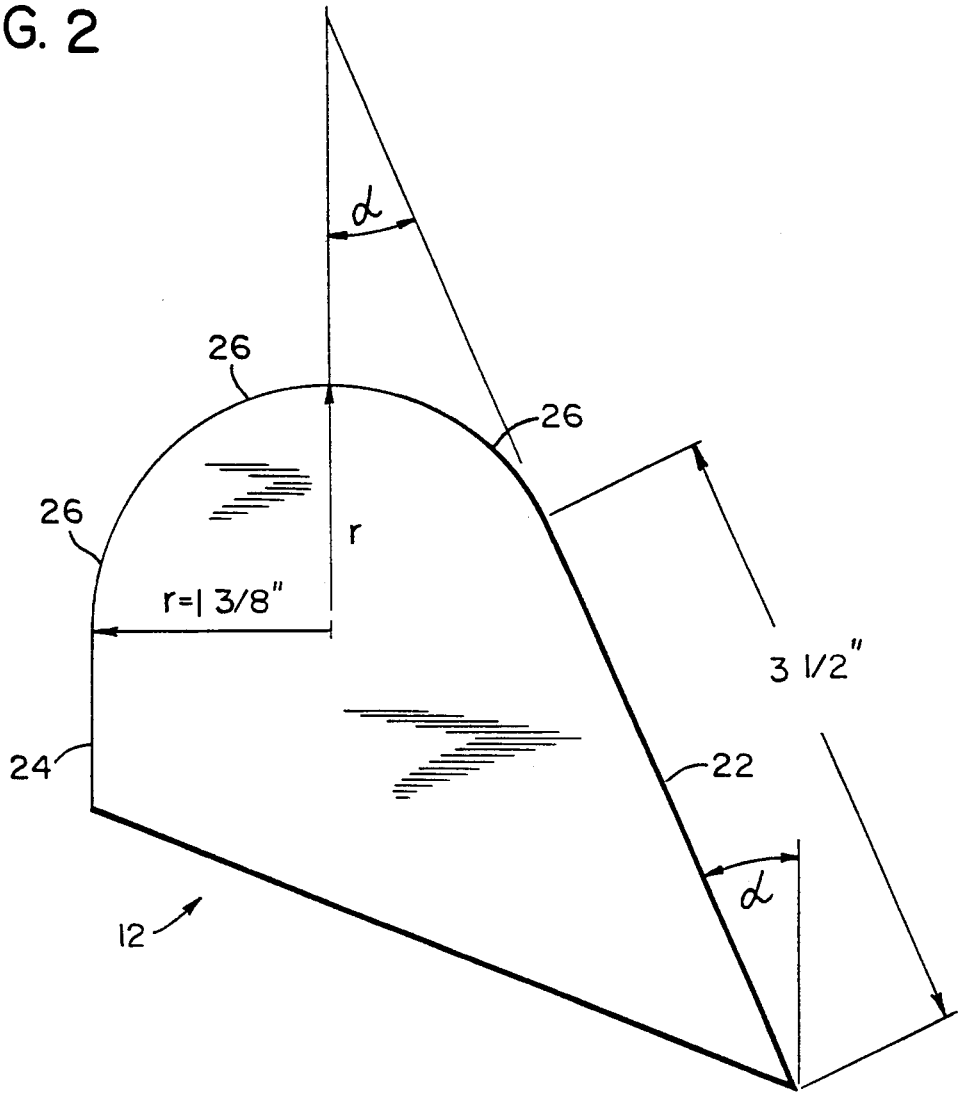
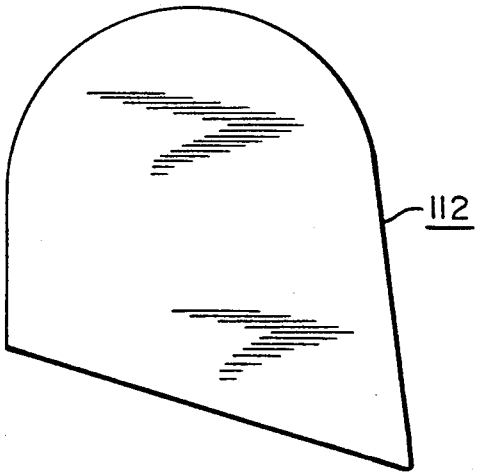
FIG. 3
PRIOR ART

LIGHTING FIXTURE

The present invention relates to lighting fixtures. More particularly, the present invention relates to lighting fixtures for illuminating hanging works of art such as paintings, photographs, tapestries, lithographs, and the like, or for washing walls having works of art or bookcases thereon.

BACKGROUND OF THE INVENTION

It is presently known to illuminate hanging works of art with a lighting fixture of particular design. These known lighting fixtures comprise a substantially semi-cylindrical shade/reflector within which one or more tubular incandescent bulbs reside. The fixture has an extending arm through which the wiring extends, and a perpendicular portion of the extending arm extends downward and is fixed by screws or the like to the back of the frame of the object to be illuminated. In this manner, the fixture extends above and a small distance out (e.g., four to twelve inches) from the plane of the object to be illuminated.

The picture lighting fixtures of the prior art have been in existence in their current state for more than fifty years and are non-optimal for several reasons: their reflectors are not carefully designed to evenly illuminate the entire object; the heat generated by the incandescent bulbs limits the choice of bulbs to those of relatively low power consumption; and their incandescent bulbs emit light of undesirable color. More particularly, in the typical known fixture, the reflector is not designed so much to distribute light evenly over the object illuminated as it is designed to shade the light from illuminating anything but the object. Moreover, the bulbs used in the known fixtures are most often twenty-five watt incandescent bulbs which emit a relative dim orange colored light and which are often insufficient to properly light a large artwork. If higher wattage bulbs are used, the light generated still will be orange-colored and unevenly distributed, and the heat generated may damage the object or objects to be illuminated.

It should be recognized that the illumination of works of art considerably influences human perception of the work, particularly with regard to color. Indeed, artists most typically paint in the daylight. Yet, to date, the lighting fixtures used to illuminate hanging works of art do not seriously address the issues of color temperature or diffusion.

Color temperature of illumination is an important consideration in the human perception of color in the object illuminated. Daylight has a color temperature of 6,500°-12,000° Kelvin which is paradoxically called a "cool" light since it is more in the blue spectrum. Typical incandescent bulbs have a color temperature of about 2,500°-2700° Kelvin and are paradoxically called "warm" lights since they are more in the red/orange spectrum. The lower the wattage of an incandescent bulb, the "warmer" its light.

Fluorescent bulbs, however, are capable of producing light with a temperature over 6,500° Kelvin which is very close to daylight and allows the most accurate human perception of color and of the color which the artist intended. Moreover, modern fluorescent bulbs are available in a number of different color temperatures which are not dependent on the power consumption of the bulbs. Fluorescent bulbs also have the advantage of generating very little heat compared to incandescent bulbs of the same brightness. For example, a typical fifteen watt fluorescent bulb emits light having a brightness of 900 lumens. An incandescent bulb generating 900 lumens would require approximately sixty watts of power and would generate substantially more heat than a fifteen watt fluorescent bulb.

While it would be advantageous to provide evenly distributed fluorescent light for illuminating hanging art work given the advantages of color temperature, brightness, lower operating temperature and lower power consumption, fluorescent bulbs have not been used for this purpose because of the large ballasts required and because small, standard, thin fluorescent bulbs do not emit enough lumens. Recently, however, light bulb manufacturers have introduced families of fluorescent bulbs with integral or separate ballasts which screw into an incandescent bulb socket (e.g. Sylvania, Osram and Phillips). Also, "E-Lamp" bulbs which utilize high-frequency radio signals instead of a filament to produce light have been announced. The new fluorescent and E-lamp bulbs offer all of the advantages of the standard fluorescent bulbs with the necessary electronics built into an oversized base which is either an integral part of the bulb or with a base into which a bulb can be inserted. Unfortunately, however, these new type bulbs do not fit into existing lighting fixtures now used to illuminate hanging works of art.

SUMMARY OF THE INVENTION

It is an object of the present invention to provide a lighting fixture which at one time is sized and shaped to evenly illuminate a hanging work of art and to receive fluorescent bulbs or E-lamp type bulbs with oversized bases.

It is another object of the present invention to provide a lighting fixture with a carefully designed reflector which evenly illuminates a hanging work of art even though the lighting fixture is placed in the conventional location above the illuminated object.

It is a further object of the invention to provide a lighting fixture for works of art with an optionally replaceable reflector surface so that the quality of the light reflected may be adjusted.

Another object of the invention is to provide a lighting fixture which is easy to manufacture, install and operate.

Yet a further object of the invention is to provide lighting fixtures utilizing compact fluorescent bulbs where the fixtures act as wall washers for illuminating book cases or entire walls of art.

Even another object of the invention is to provide a lighting fixture which produces a light in the temperature range of daylight so that a work of art can be seen in a light most similar to which it was painted.

The objects of the invention are achieved by the lighting fixture which comprises a housing/reflector which is wide enough to receive the oversized base of the new compact fluorescent bulbs or E-lamp type bulbs and which is shaped with a planar portion extending at a carefully chosen angle. The housing of the lighting fixture of the invention has a front portion which extends downward considerably further than the rear portion of the lighting fixture. The interior of the housing is optionally provided with different types of reflective material to alter the quality of the light reflected. Alternatively, the interior of the housing is adapted to accept a number of different reflective materials. The lighting fixture of the invention can be easily constructed of extruded material and is provided with all of the features for placement necessary to illuminate hanging works of art.

Additional objects and advantages of the invention will become apparent to those skilled in the art upon reference to the detailed description taken in conjunction with the provided figures.

BRIEF DESCRIPTION OF THE DRAWINGS

FIG. 2 is an actual size cross-section of the reflector of the lighting fixture invention;

FIG. 3 is an actual size comparative view similar to FIG. 2, but of a prior art reflector;

DETAILED DESCRIPTION OF THE PREFERRED EMBODIMENT

Figure 1:
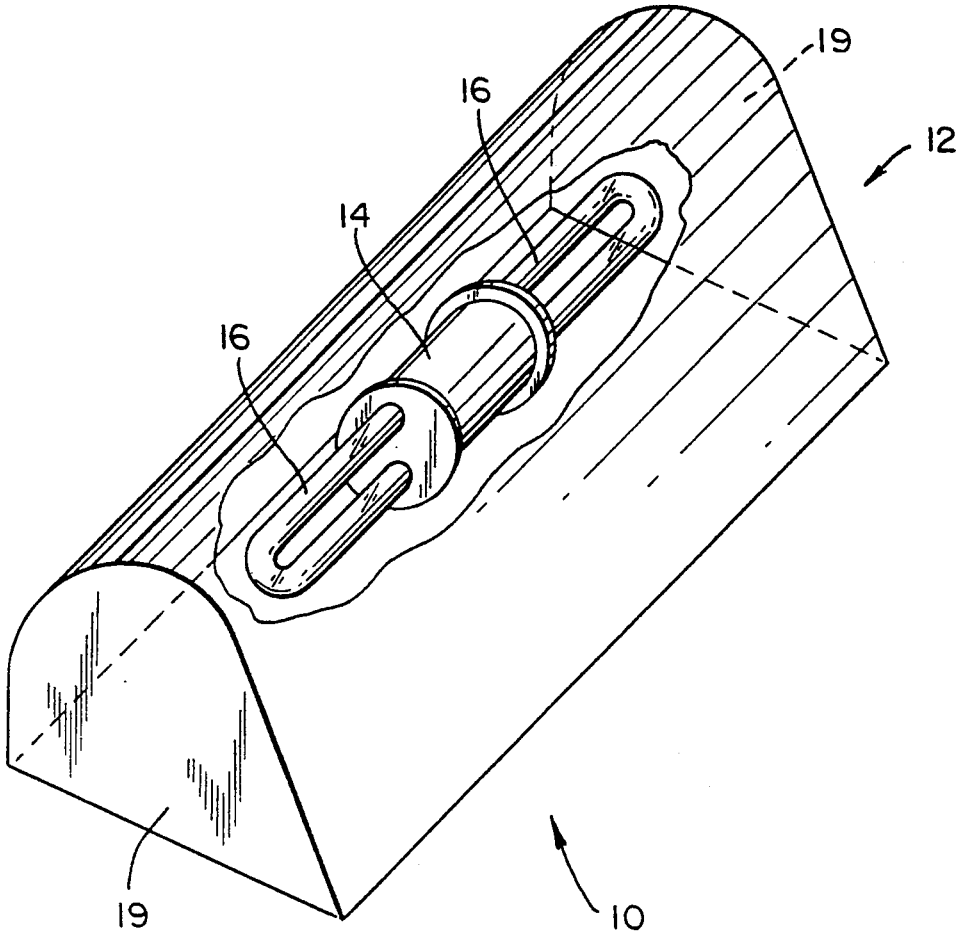
FIG. 1 is a perspective view of the reflector of the lighting fixture invention.

Referring to FIG. 1 the lighting fixture 10 of the invention comprises an enlarged reflector 12 which is large enough in diameter (e.g., at least two and one-half inches and preferably three inches in diameter) to accommodate one or more compact fluorescent bulbs or E-lamp type bulbs 16 the bases of which screw into one or more ordinary incandescent bulb sockets 14. The compact fluorescent bulbs or E-lamp type bulbs used may be any of a number of types which are constructed with either separate or integral self-contained electronics (ballasts) in an oversized base 18 where the base screws into an ordinary incandescent bulb socket. Bulbs which have integral ballasts and bulbs which have separate ballasts into which the bulb is snapped or inserted are both manufactured by Sylvania, and are available in five, seven, nine, thirteen, eighteen and twenty-six watts, ranging in length from almost seven to slightly over ten inches in length. The rated color temperature of the Sylvania bulbs also ranges from 2700K for the five watt bulbs, to choices of 2700K, 3500K, and 4100K for the thirteen, eighteen, and twenty-six watt bulbs. Other bulbs with integral ballasts are distributed by Osram Corporation, Montgomery, N.Y. as the Osram Dulux EL bulbs. The Osram bulbs are available in eleven, fifteen, and twenty-one watt versions. Regardless of manufacturer, the twenty-one watt bulb which has a brightness equivalent to a ninety watt incandescent bulb is preferred, although the fifteen watt bulb (sixty watt incandescent equivalent) may be suitable for many applications. For purposes herein, the invention will be described hereinafter with reference to the new type of fluorescent bulbs (compact fluorescents) with integral electronic bases only, it being understood that the other aforedescribed fluorescent and E-lamp type bulbs may be similarly utilized.

Figure 7:
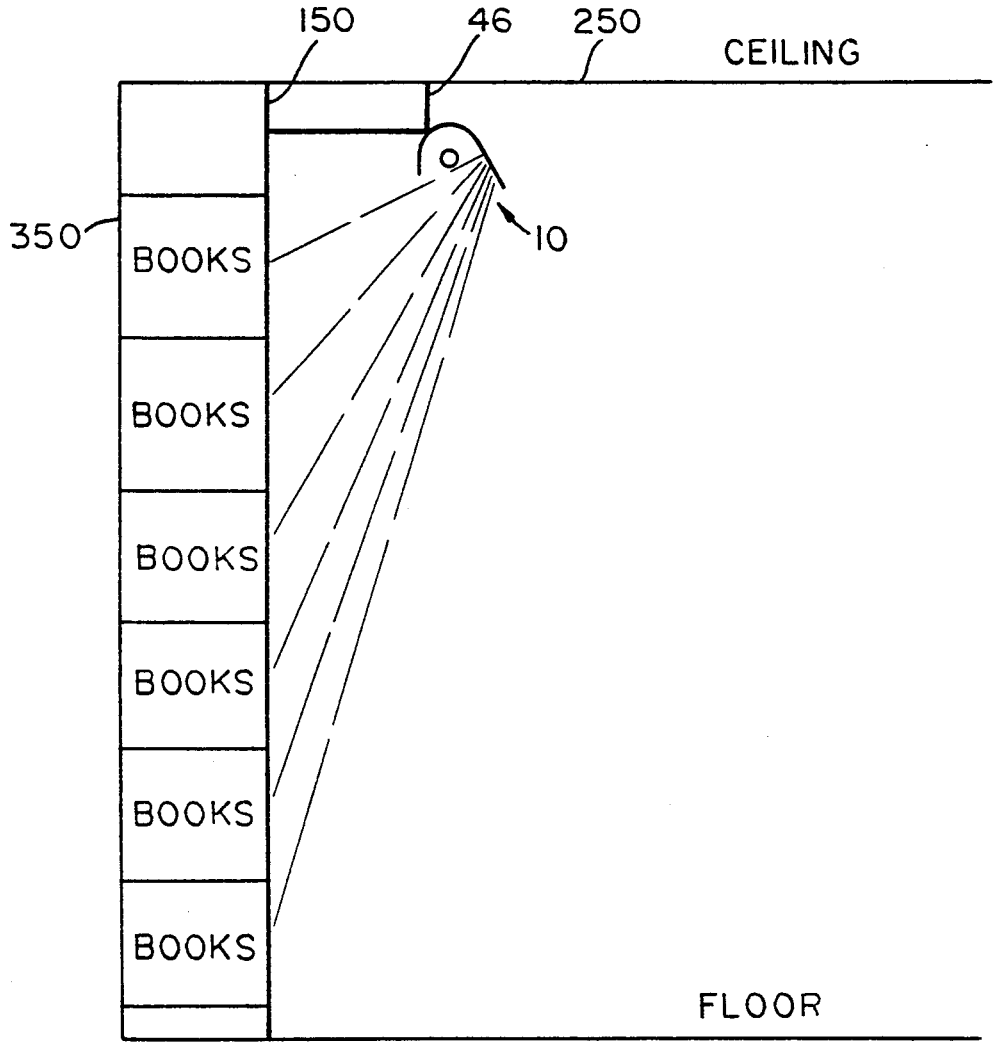
FIG. 7 is a side elevational schematic of the lighting fixture of the invention mounted to a book case or to a ceiling for illuminating an entire wall of bookcases.

In the exemplary embodiment of FIG. 1, a pair of sockets 14 are centrally located back to back within the reflector 12 so that two bulbs 16 may be mounted opposite to each other as shown. Nevertheless, it is entirely within the scope of the invention to provide a single socket 14 located at one side of the reflector 12, or a series of pairs of sockets evenly spaced across a very long reflector. Clearly, the number and placement of sockets 14 depends largely on the size of the object which will be illuminated. A primary function of the fixture which can be extruded in lengths typically up to eighteen feet long is to act as a wall washer. As a wall washer, the fixture provides evenly distributed light from about ten inches off the ceiling to a couple of feet off the floor for art illumination, and sufficient light all of the way down to the floor for book case purposes. Since the fixtures of the invention can be butted end to end and wired in parallel (or as otherwise desired), a wall of any length can be illuminated. As seen in FIG. 7, such a fixture can be attached to the wall or ceiling as opposed to the work of art itself. This ability provides distinct advantages, as until now, wall washing was accomplished by using a ceiling mounted track with very high wattage; e.g. 175 watt spot bulbs mounted on a track at approximately two foot intervals approximately six feet away from the work of art. Such an arrangement produces uneven light on the wall at best, and extreme heat from the light sources which can only be dissipated and overcome by high air movement and air conditioning to cool the air in the entire room.

An important feature of the inventive lighting fixture is the size and shape of the reflector 12. This is better shown in FIG. 2 where it can be seen that the reflector 12 comprises a long planar front portion 22 and very short planar rear portion 24 joined by a curved or arcuate joining portion 26. Although these are referred to as separate portions, the entire reflector, except for side ends 19 (see FIG. 1) preferably comprises a single piece of extruded material. Thus, the word "portion" as used herein should not imply separate pieces of material. Moreover, it should be appreciated that the terms "forward" and "rear" are intended to be terms which are relative to the viewer. Thus, the "forward" portion is the portion closest the viewer of the work of art, while the rear portion is the portion closest the work of art.

The geometry of the reflector 12 of the invention is particularly important. In accord with the preferred embodiment, the front portion 22 of the reflector is long and planar, is preferably about three to three and a half inches long, and as seen in FIG. 2 extends at an angle $\alpha = 30° + 10°$ from the vertical. The advantage of the long planar outer section 22 of the reflector 12 of the invention is readily appreciated by comparing the light reflecting properties of the reflector of the invention (shown in FIG. 4) with the reflecting properties of the prior art reflector 112 (shown in FIG. 5). Comparing FIGS. 4 and 5, it is seen that the reflecting properties of the prior art fall short of illuminating all but the upper portion of a reasonably sized object (framed picture) 30. The reflecting properties of the reflector 12, however, are much improved and reflect light far down from the fixture itself.

Returning to FIG. 2 and the geometry of the reflector 12, it is seen that the arcuate portion 26 of the reflector is preferably substantially semicircular (it extends approximately one hundred and fifty degrees around) and has a radius of at least one and a quarter inches. This radial dimension should be considered a minimum dimension in order to accommodate a bulb of the type described above. It should be appreciated, however, that the arcuate portion 26 need not be exactly semicircular, but could be oblong or otherwise arcuate, provided sufficient room is provided for the fluorescent bulb. In fact, arcuate portion 26 need not even be smoothly curved, as it could be comprised of a series of planar sections if desired. Regardless, at the base of the fluorescent bulb, a "diameter" of a minimum of two and a half inches is required between one side of the arcuate portion 26 or the long planar front portion 26 and the other side of the arcuate portion 26 or the short planar rear portion 24.

The back or rear portion 24 of the reflector serves to reflect light which would illuminate primarily the frame or the wall above the frame, so that the light can be re-reflected by the long front portion 22 and illuminate the work of art. Back portion 24, which in the preferred embodiment is approximately one inch long, need not be planar but could be curved. In fact, back portion 24, while definitely desirable, is not absolutely required.

It will be appreciated that with the geometry and sizes provided, the reflector 12 of the invention presents a different shape than the reflector 112 of the prior art seen in FIG. 3. In fact, the reflector 112 of the prior art is neither capable of receiving a compact fluorescent bulb, nor of providing as even a lighting to a large painting as the reflector 12 of the invention. Indeed, the reflector 112 of the prior art will provide very little light to the lower portion of a painting which has a height over twenty-four inches regardless of the angle variation manually achieved by angling the fixture in different directions.

It should be appreciated that it is entirely within the scope of the invention that the dimensions given above for the different portions of the reflector may vary in magnitude and even somewhat in proportion. However, preferably, the vertical height from the edge of the rear portion 24 to the top of the arcuate portion 26 is at most one half the vertical height from the edge of the front planar portion 22 to the same point at the top of the arcuate portion.

Figure 4:
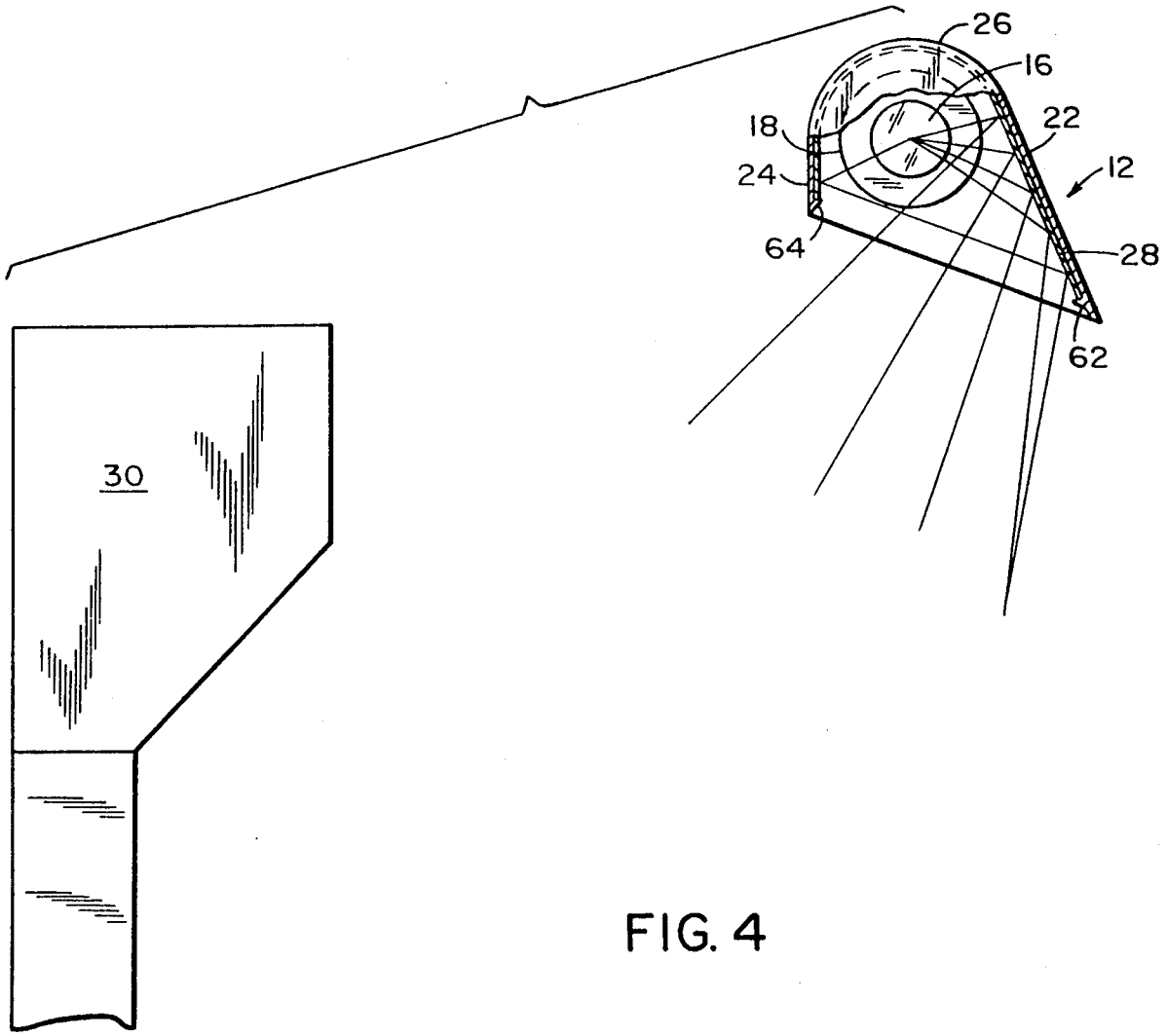
FIG. 4 is a view similar to FIG. 2 showing angles of reflection of light in the inventive reflector relative to a picture.
Figure 5:
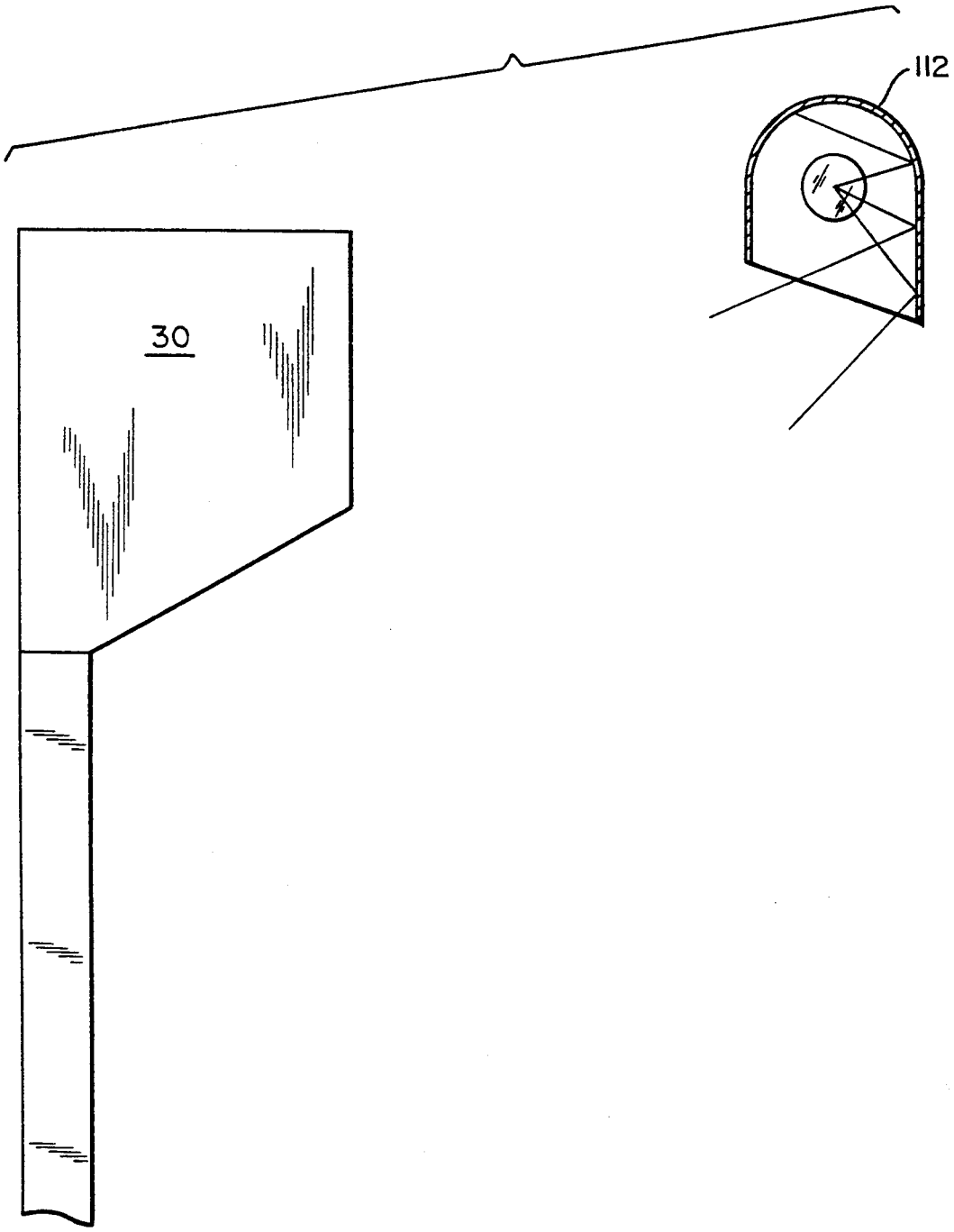
FIG. 5 PRIOR ART
FIG. 5 is a comparative view similar to FIG. 4, but of the prior art reflector.
Figure 6:
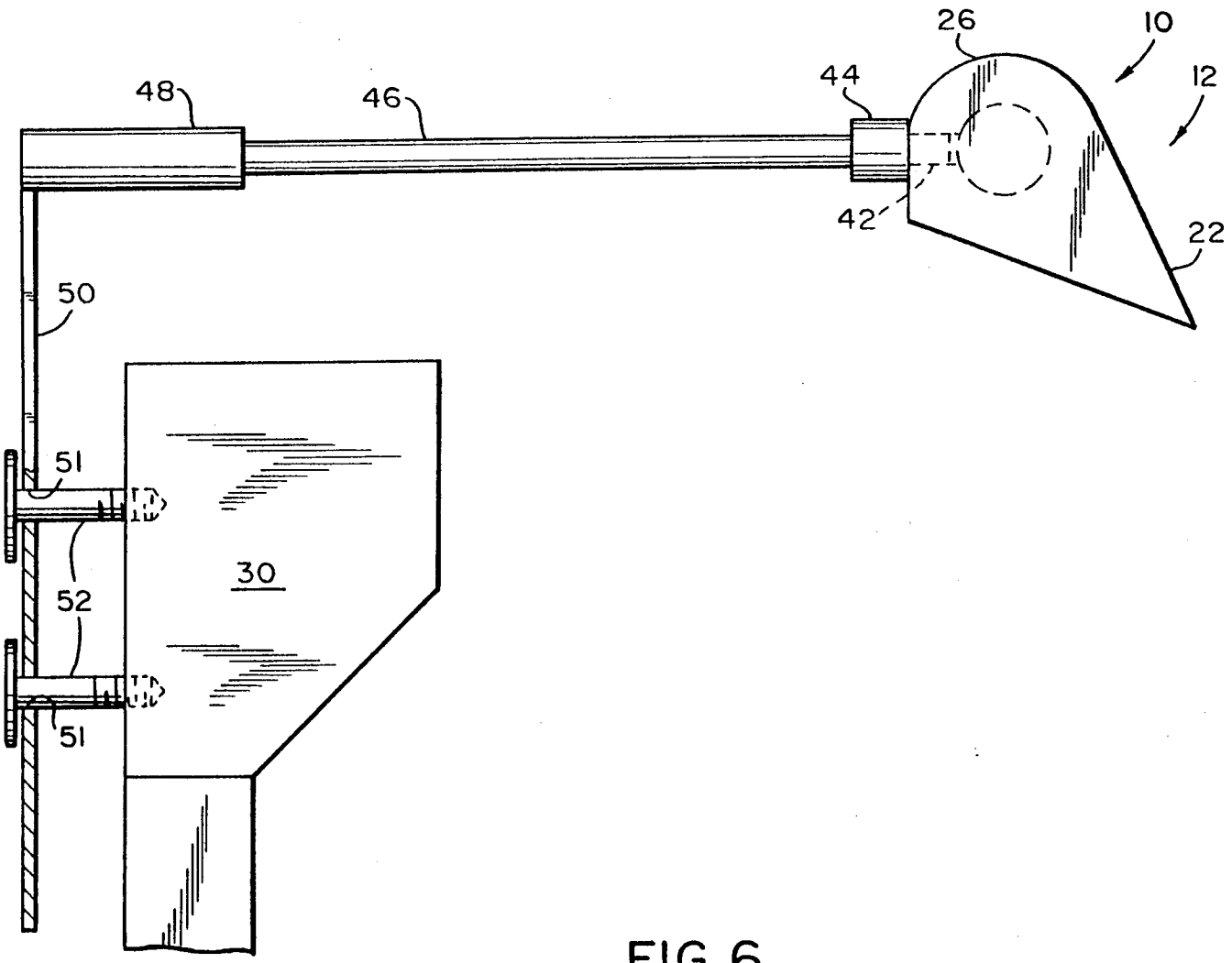
FIG. 6 is a side elevation of the lighting fixture of the invention mounted to a frame of a hanging work of art.

As will be seen in reference to FIG. 6, the reflector portion 12 may be tilted relative to a fixed vertical axis and thus the angle a may vary substantially relative to a fixed vertical axis. Thus, for the purpose of understanding the invention, the angle $\alpha$ must be considered relative to a tiltable vertical axis of the tiltable reflector 12. Moreover, it is contemplated that angle $\alpha$ relative to the tiltable vertical axis of the ref lector may vary by at least $\pm 5°$ and even $\pm 10°$ or more and still yield satisfactory results as shown in FIG. 4 as compared to FIG. 5 discussed above.

The lighting fixture of the present invention comprises additional features which are best understood with reference to FIG. 6. As can be seen in FIG. 6, the lighting fixture 10 is placed relative to an object 30 such as a framed hanging work of art in a conventional manner. That is, the reflector portion 12 of the fixture 10 is placed above the object to be illuminated 30 and extends a small distance out from the plane of the object to be illuminated 30 (or the wall (not shown) on which the object hangs). Electrical wiring necessary for socket(s) 14 passes through a mounting conduit 42 which also serves to locate socket(s) 14 relative to the reflector portion 12. This mounting conduit 42 ideally passes through a tilting joint 44 so that the angle of the outer section 22 of reflector 12 may be varied relative to the fixed vertical axis of the object 30.

It is advantageous that the tilting joint 44 connect with a telescoping conduit 46 which may telescope in a known way through extension conduit 48. A set screw (not shown) is used to set conduit 46 relative to conduit 48. The larger telescoping extension conduit 48 terminates at a frame mounting bracket 50 of conventional type and the electrical wiring passing through conduits 42, 46, 48 is made available in a conventional way behind the frame 30. As shown in FIG. 6, the frame mounting bracket 50 has holes 51 through which screws 52 extend so that the fixture 10 may be jointed to the frame 30. Alternatively, as indicated in FIG. 7, the "frame" mounting bracket 50 can be screwed into a wall 150, a ceiling 250 or into a bookcase 350.

Returning to FIG. 4, and as mentioned above, it is also considered that the reflective nature of the reflector 12 may be made adjustable by allowing the placement and/or removal of sheet material such as plastic or metallic reflector material of different color and/or reflectivity. FIG. 4 shows two small extending edges or barbs 62 and 64 near respective ends of portions 22 and 24 of the reflector. While in some embodiments, the interior of reflector 12 may be coated with reflective finish or paint, in other embodiments, it may be desirable to alter the reflective properties of the interior of reflector 12. This may be accomplished by inserting in the interior of reflector 12 a flexible sheet (metallic, plastic or the like) of reflective material 28. Extending edges or barbs 62 and 64 are designed to hold such material in place. It is contemplated that such material might have such reflective characteristics as to alter the intensity, color temperature and other aspects of the light reflected by reflector 12.

There have been illustrated and described herein lighting fixtures utilizing compact fluorescent bulbs and the like. While particular embodiments of the invention have been described, it is not intended that the invention be limited thereto, as it is intended that the invention be as broad in scope as the art will allow and that the specification be read likewise. Thus, while particular compact fluorescent bulbs such as Sylvania, Osram, and Philips bulbs, and while E-lamp type bulbs were described, it will be appreciated that the invention could use other similar type bulbs. Also, while particular bulb wattages and lengths were described, it will be appreciated that bulbs of different wattages and lengths can be used, and that two or more bulbs can be used in conjunction with each other in one or more reflectors to illuminate wide areas, including entire walls. It will therefore be appreciated by those skilled in the art that yet other modifications could be made to the provided invention without deviating from its spirit and scope as so claimed.

I claim:

1. A lighting fixture for use with a compact fluorescent or E-lamp type bulb for illuminating works of art or the like hanging vertically from a vertical wall, comprising:

a) a reflector having a planar front portion, an arcuate portion continuing from said planar front and a back planar portion which continues from said arcuate portion, said back planar portion being substantially parallel said vertical wall, said planar front portion being disposed at an angle of $30° \pm 10°$ to said vertical and said planar front portion extending down beyond said back planar portion;

b) at least one bulb socket disposed in said arcuate portion for receiving the bulb, said arcuate portion having a radius of at least 1.25 inches;

c) a mounting means for supporting said reflector, said mounting means having first and second ends, said first end being coupled to said reflector at a location other than on said planar front portion and said second end adapted to be coupled to a picture frame vertically hanging from the vertical wall or from the vertical wall.

2. A lighting fixture according to claim 1, wherein: said planar front portion is at least three inches long.

3. A lighting fixture according to claim 1, wherein: the vertical height of said reflector form the end of said back planar portion to the top of said arcuate portion is at most one half the vertical height of said reflector from the end of said front planar portion to said top of said arcuate portion.

4. A lighting fixture according to claim 3, wherein: said planar front portion is at least three inches long.

5. A lighting fixture according to claim 1, further comprising: a flexible sheet liner for lining the inner surface-of said reflector, wherein said reflector further includes means for securing said flexible sheet liner to said reflector.

6. A lighting fixture according to claim 5, wherein: said means for securing said flexible sheet liner to said reflector includes first barb means extending inwardly from said planar front portion at a location near an edge of said planar front portion, and second barb means extending inwardly from said reflector at a location near a second edge of said reflector.

7. A lighting fixture according to claim 1, further comprises:

electrical wiring coupled to said bulb socket, wherein said mounting means includes a conduit through which said electrical wiring extends.

8. A lighting fixture according to claim 1, wherein: said planar front portion is at least three inches long, said back planar portion being small relative to said planar front portion such that the vertical height of said reflector from the end of said back planar portion to the top of said arcuate portion is at most one half the vertical height of said reflector from the end of said front planar portion to said top of said arcuate portion, said mounting means mounts to said back planar portion or to said arcuate portion adjacent said back planar portion, and said mounting means includes a conduit adapted for receiving electrical wiring.

9. A lighting fixture according to claim 8, further comprising:

a flexible sheet liner for lining the inner surface of said reflector, wherein said reflector further includes first barb means extending inwardly from said planar front portion at a location near an edge of said planar front portion, and second barb means extending inwardly from said reflector at a location near an edge of said planar rear portion, said first and second barb means for securing said flexible sheet liner to said inner surface of said reflector.

10. A combination of the lighting fixture according to claim 1 in conjunction with a compact fluorescent bulb electronic ballast.

11. A combination of the lighting fixture according to claim 1 in conjunction with a compact fluorescent bulb with a rated color temperature of over 2700 degrees Kelvin.

12. A lighting fixture for use with a compact fluorescent or E-lamp type bulb for illuminating works of art or the like hanging vertically from a vertical wall, comprising:

a) a reflector having a planar front portion of at least three inches in length, an arcuate portion continuing from said planar front portion, said arcuate portion making an arc of approximately one hundred fifty degrees, and a back planar portion which continues from said arcuate portion and is substantially parallel said vertical wall;

b) at least one bulb socket disposed centrally in said arcuate portion, said arcuate portion having a radius of at least 1.25 inches;

c) a mounting means for supporting said reflector, said mounting means having first and second ends, said first end being coupled to said reflector at a location other than on said planar front portion and said second end adapted to be coupled to a picture frame or a wall.

13. A lighting fixture according to claim 12, wherein: said back planar portion being small relative to said planar front portion such that the vertical height of said reflector from the end of said back planar portion to the top of said arcuate portion is at most one half the vertical height of said reflector from the end of said front planar portion to said top of said arcuate portion.

14. A combination of the lighting fixture according to claim 12, in conjunction with a compact fluorescent bulb electronic ballast.

15. A lighting fixture according to claim 14, wherein: said back planar portion being small relative to said planar front portion such that the vertical height of said reflector from the end of said back planar portion to the top of said arcuate portion is at most one half the vertical height of said reflector from the end of said front planar portion to said top of said arcuate portion.

16. A combination of the lighting fixture according to claim 12 in conjunction with a compact fluorescent bulb with a rated color temperature of over 2700 degrees Kelvin.

* * * * *